US009225114B2

(12) United States Patent
Sinclair

(10) Patent No.: US 9,225,114 B2
(45) Date of Patent: Dec. 29, 2015

(54) RADIAL ELECTRICAL CONNECTOR RESISTANT TO FLUIDS

(71) Applicant: Paul L. Sinclair, Austin, TX (US)

(72) Inventor: Paul L. Sinclair, Austin, TX (US)

(73) Assignee: CBG Corporation, Austin, TX (US)

( * ) Notice: Subject to any disclaimer, the term of this patent is extended or adjusted under 35 U.S.C. 154(b) by 66 days.

(21) Appl. No.: 13/859,695

(22) Filed: Apr. 9, 2013

(65) Prior Publication Data

US 2014/0030906 A1 Jan. 30, 2014

Related U.S. Application Data

(60) Provisional application No. 61/621,999, filed on Apr. 9, 2012.

(51) Int. Cl.

| | |
|---|---|
| ***H01R 13/44*** | (2006.01) |
| ***H01R 13/627*** | (2006.01) |
| ***H01R 43/26*** | (2006.01) |
| ***H01R 13/24*** | (2006.01) |
| ***H01R 13/453*** | (2006.01) |
| *H01R 13/533* | (2006.01) |

(52) U.S. Cl.

CPC ..... *H01R 13/6276* (2013.01); *H01R 13/2478* (2013.01); *H01R 13/4538* (2013.01); *H01R 43/26* (2013.01); *H01R 13/533* (2013.01); *Y10T 29/49208* (2015.01)

(58) Field of Classification Search

CPC ..... H01R 13/4538
USPC ..... 439/140, 17, 660, 271, 272
See application file for complete search history.

(56) References Cited

U.S. PATENT DOCUMENTS

| | | | | | |
|---|---|---|---|---|---|
| 2,892,990 | A * | 6/1959 | Werndl | 439/265 | |
| 3,491,326 | A * | 1/1970 | Pfister et al. | 439/141 | |
| 3,524,160 | A * | 8/1970 | Robinson | 439/131 | |
| 3,641,479 | A * | 2/1972 | O'Brien et al. | 439/277 | |
| 3,665,509 | A * | 5/1972 | Elkins | 439/42 | |
| 3,766,512 | A * | 10/1973 | Falbet | 439/101 | |
| 3,845,450 | A * | 10/1974 | Cole et al. | 439/141 | |
| 4,080,025 | A * | 3/1978 | Garnier et al. | 439/191 | |
| 4,117,287 | A * | 9/1978 | Walker et al. | 200/82 R | |
| 4,157,857 | A * | 6/1979 | Sabo | 439/637 | |
| 4,162,116 | A * | 7/1979 | Lehmann | H01H 23/06 | 439/278 |
| 4,188,084 | A * | 2/1980 | Buresi et al. | 439/201 | |
| 4,438,996 | A * | 3/1984 | Zehren | 439/137 | |
| 4,859,196 | A * | 8/1989 | Durando et al. | 439/197 | |
| 5,140,659 | A * | 8/1992 | Minds et al. | 385/66 | |
| 5,346,400 | A * | 9/1994 | Shin | G08B 13/00 | 439/17 |
| 5,484,296 | A * | 1/1996 | Taylor | 439/140 | |
| 5,927,402 | A | 7/1999 | Benson et al. | | |
| 6,416,334 | B1 * | 7/2002 | Plishner | 439/75 | |
| 6,498,952 | B2 * | 12/2002 | Imani et al. | 607/37 | |
| 7,500,859 | B2 * | 3/2009 | Dubranna | 439/140 | |

(Continued)

*Primary Examiner* — Neil Abrams
(74) *Attorney, Agent, or Firm* — Campbell Stephenson LLP

(57) ABSTRACT

A wet-connect can include a radial array of contacts that are electrically isolated from each other. The wet-connect can include a male connector and a female connector. The contacts are placed at spaced distances from each other around the outside diameter of the male connector and the inside diameter of the female connector. Because the contacts are spaced around the radius of the connectors, the length of the wet-connect does not have to depend upon the number of contacts provided by the wet-connect. This in turn can reduce the length of the wet-connect, making the wet-connect less susceptible to breakage or misalignment and/or allowing the wet-connect to be manufactured using less material.

8 Claims, 3 Drawing Sheets

(56) References Cited

U.S. PATENT DOCUMENTS

| | | | | |
|---|---|---|---|---|
| 7,770,656 | B2 * | 8/2010 | Zupanick | 166/385 |
| 7,845,966 | B2 * | 12/2010 | Rioufreyt et al. | 439/367 |
| 2002/0123256 | A1 * | 9/2002 | Brickett | 439/140 |
| 2005/0070141 | A1 | 3/2005 | Dopf et al. | |
| 2008/0047703 | A1 | 2/2008 | Stoesz et al. | |
| 2009/0045146 | A1 | 2/2009 | Stoesz | |
| 2011/0177697 | A1 | 7/2011 | Cairns | |
| 2014/0030906 | A1 * | 1/2014 | Sinclair | 439/349 |

* cited by examiner

PEEK CONTACT ASSY
175
BLEEDER PORT 197
WAVE SPRING 145
B
B
PEEK PLUG 180
165
TERMINALS (6) 190(1)-190(6)
FEMALE CONNECTOR 160

CONTACT BLOCKS (6)
CONTACTS 185(1)-185(6)
185(1)
185(2)
185(3)
185(4)
185(5)
185(6)
PEEK PLUG
SECTION B-B

END OF MALE

PEEK SLEEVE 140
110
150
WAVE SPRING 145
A
A
110
135
PEEK PLUNGER ASSY
#10-32 x 1.25 BOLT
Contacts 125
MALE CONNECTOR 120

TERMINALS (6) 130(1) - 130(6)
BALL PLUNGERS (6) 125(1)-125(6)
125(1)
125(2)
125(3)
125(4)
125(5)
125(6)
PEEK SLEEVE 140
SECTION A-A

RADIAL ELECTRICAL CONNECTOR RESISTANT TO FLUIDS

PRIORITY CLAIM

This application claims the domestic benefit under Title 35, United States Code §119(e) of U.S. Provisional Patent Application Ser. No. 61/621,999, entitled "Fluid-Resistant Radial Electrical Connector," filed Apr. 9, 2012, and naming Paul L. Sinclair as the inventor. This application is assigned to CBG Corporation, the assignee of the present invention, and is hereby incorporated by reference in its entirety and for all purposes as if completely and fully set forth herein.

FIELD OF THE INVENTION

This invention relates to the field of electrical connectors and, more particular, to electrical connectors that may be exposed to fluids.

DESCRIPTION OF THE RELATED ART

Electrical connectors allow two components to be electrical coupled, so that the two components can communicate electrical signals to each other. In many situations, it is desirable to be able to expose an electrical connector to a potentially wet environment, which may include fluids that can possible interfere with the electrical isolation between the signals coupled by the electrical connector. For example, in drilling operations, it is desirable to be able to retrieve batteries or other electronic equipment located in a bottom-hole assembly (BHA) via wireline retrieval. Wireline retrieval allows the electrical component to be retrieved without having to remove the entire BHA from the wellbore in order to reduce interference with an ongoing drilling operation and to avoid the expense of bringing the entire BHA to the surface. An electrical connector designed to provide electrical isolation of the electrical signals coupled by the connector in potentially wet environments is commonly referred to as a "wet-connect."

Unfortunately, many current wet-connect designs that provide satisfactory electrical isolation in potentially wet environments are susceptible to other disadvantages. For example, a common wet-connect design includes a linear coaxial array of electrical contacts in the form of contact rings that are spaced linearly along the connector. Insulating rings are placed between each of the contact rings. The connector includes a male part that is designed to be inserted into a female part, such that when the male and female parts are coupled, the contact rings in the male part will be electrically coupled to corresponding contact rings in the female part. Unfortunately, the length of such a connector is determined by the number of ring contacts needed for the desired number of electrical signals to be coupled, so that as the number of contacts increases, so does the length of the connector. If a large number of contacts is needed, the connector length can contribute to problems such as breakage of the wet-connect or potential misalignment of the male and female parts of the wet-connect. Additionally, certain types of connectors of this type are susceptible to cross-connection of the ring contacts while the male and female parts are being connected, which can potentially damage the components being connected. As these examples show, additional wet-connect designs are desirable.

BRIEF DESCRIPTION OF THE DRAWINGS

A more complete understanding of the present invention may be acquired by referring to the following description and the accompanying drawings, in which like reference numbers indicate like features.

Figures 1A, 1B, 1C, 2A, 2B:
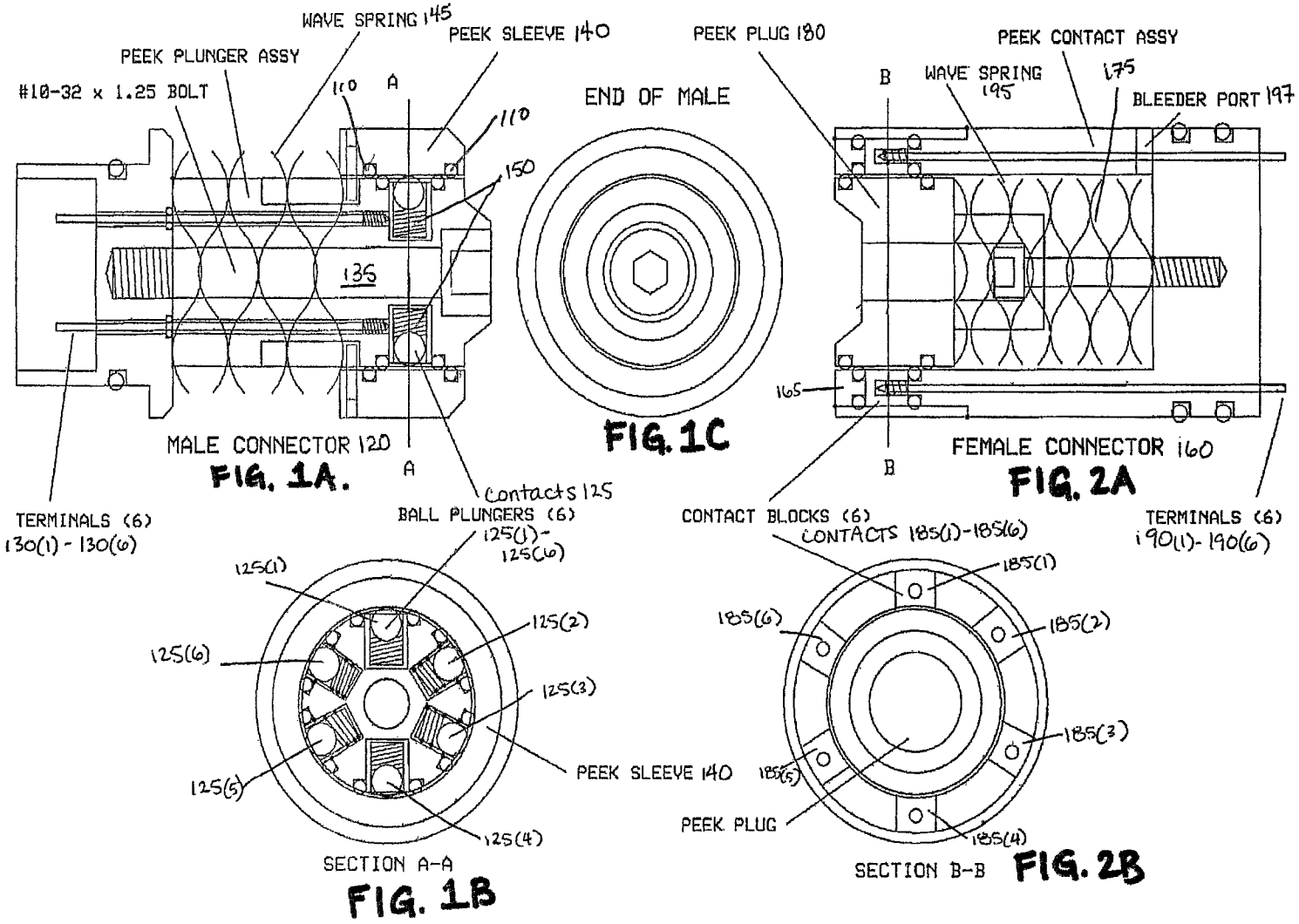
FIG. 1A illustrates a side view of a male connector, according to one embodiment of the present invention.
FIG. 1B illustrates a cross-section of the male connector shown in FIG. 1A, according to one embodiment of the present invention.
FIG. 1C shows the end of the male connector shown in FIG. 1A, according to one embodiment of the present invention.
FIG. 2A illustrates a side view of a female connector, according to one embodiment of the present invention.
FIG. 2B illustrates a cross-section of the female connector shown in FIG. 2A, according to one embodiment of the present invention.

While the invention is susceptible to various modifications and alternative forms, specific embodiments of the invention are provided as examples in the drawings and detailed description. It should be understood that the drawings and detailed description are not intended to limit the invention to the particular form disclosed. Instead, the intention is to cover all modifications, equivalents and alternatives falling within the spirit and scope of the invention as defined by the appended claims.

DETAILED DESCRIPTION

A wet-connect, which is an electrical connector that is at least somewhat resistant to malfunctioning when exposed to fluids, can include a radial array of contacts that are electrically isolated from each other. The wet-connect includes a male connector and a female connector. The contacts are placed at spaced distances from each other around the outside diameter (such spaced contacts are referred to herein as being "radially distributed") of the male connector and the inside diameter of the female connector. Because the contacts are spaced around the radius of the connectors (in contrast to existing wet-connects, which space the contacts linearly along the length of the connector), the length of the wet-connect does not have to depend upon the number of contacts provided by the wet-connect. This in turn can reduce the length of the wet-connect, making the wet-connect less susceptible to breakage or misalignment and/or allowing the wet-connect to be manufactured using less material.

The wet-connect can also include a mechanism that prevents the male and female connectors from being fully connected (and thus the contacts on each electrically connected to each other) unless the male and female connectors are properly aligned with one another. This reduces the likelihood of electrical cross-connections while the male and female connectors are being connected.

FIGS. 1A-1C illustrate a various views of a male connector portion 120 of one embodiment of a wet-connect. FIG. 1A shows a side cut-through view of a male connector 120. FIG. 1B shows a cross-sectional view of the male connector 120 taken at location A-A of FIG. 1A. FIG. 1C shows the contact end of the male connector 120.

As shown in FIG. 1A, the male connector 120 is implemented as a peek plunger assembly. The electrical contacts 125(1)-125(6) (collectively referred to as contacts 125) in this embodiment are implemented using ball plungers, which are arranged at one end of the male connector 120. The other end of the male connector 120 is configured to be connected to one of the two electrical devices (not shown) that are to be electrically coupled by the wet-connect. This end of the male connector 120 includes several terminals 130(1)-130(6) (only two of which can be seen in this orientation and example), each of which is electrically connected to a corresponding one of the ball plunger contacts 125.

As shown, the male connector includes a bolt that is covered by a peek sleeve. A wave spring forces the peek sleeve to fully cover the bolt, including the area that includes the ball plunger electrical contacts, when the male connector is detached from the female connector. The peek sleeve can include gaskets 110 that surround the plane of the bolt (marked A-A) that includes the electrical contacts in order to reduce the likelihood of fluids reaching the electrical contacts when the male connector is not connected to the female connector and is exposed to fluids.

When the male connector 120 is brought into contact with the female connector 160 (shown in FIGS. 2A and 2B), the outer sleeve 165 of the female connector pushes the peek sleeve 140 back, causing the male connector's wave spring 145 to compress and exposing the electrical contacts 125 at the end of the male connector 120. This causes the contacts 125 on the male connector 120 to be exposed to the inside of the female connector 160, which is itself protected from fluids as described below. The use of the peek sleeve 140 thus protects the electrical contacts 125 from being exposed to environmental fluids while the male 120 and female 160 connectors are separated and during the process in which the male 120 and female 160 connectors are being mated to each other.

In this example, the ball plunger contacts 125 include electrically conductive balls that are recessed into the surface of the bolt 135. A spring can be placed into the recess 150 underneath each electrically conductive ball in order to force the ball outwards from the bolt 135. This force can help the ball connect to a corresponding contact block in the female connector 160 when the male and female connectors are fully connected.

The ball plunger contacts 125 are electrically isolated from each other by an insulating material. In one embodiment, each ball plunger 125 is surrounded by an individual O-ring gasket arranged on (or at least partially recessed into) the surface of the bolt portion 135 of the male connector 120. In other embodiments, a single strip of insulating material (e.g., a rubber gasket with holes arranged to expose the top of each ball plunger) surrounds the entire diameter of the bolt 135 in the plane of the electrical connectors 125. In generally, any arrangement of insulating material that electrically isolates the electrical contacts 125 can be used.

In this example, the male connector 120 provides six electrical contacts 125, allowing the wet-connect to electrically couple six electrical signals (e.g., power, ground, and four other signals). As shown in FIG. 1B, the electrical contacts 125 are evenly spaced from one another around the diameter of the bolt 135. In particular, the electrical contacts 125 are positioned every 60 degrees around the diameter of the bolt 135.

In general, any number of contacts can be placed in the same plane around the diameter of the male connector, so long as enough distance is left between contacts to provide electrical isolation between each pair of adjacent contacts. For even spacing, N contacts can be spaced 360/N degrees apart, where N is the number of contacts. Uneven spacing can also be used, so long as each pair of adjacent contacts is spaced far enough apart to provide electrical isolation from each other. A similar number of similarly-spaced contacts can be implemented on a corresponding female connector.

While the example of FIGS. 1A-1C shows an embodiment in which the electrical contacts are all aligned in the same plane, other embodiments may be implemented differently. For example, in some embodiments, it is desirable for certain electrical signals (e.g., such as power and ground) to be connected sooner than other electrical signals. In such embodiments, the contacts for some signals can be located closer to the contact end of the male connector, while the contacts for the other signals can be located closer to the terminal end of the male connector. All of the contacts are still located at different radial locations than each other; however, some of the contacts will be in a different plane (perpendicular to the axis of the male connector) than the others. The corresponding contacts in the female connector can be arranged so that, when mated, those contacts will be located in the appropriate positions to be electrical coupled to the contacts on the male connector. Accordingly, when the male connector is mater to the female connector the contacts that are closer to the contact end of the male connector will be electrically coupled to the corresponding contacts of the female connector slightly before the contacts closer to the terminal end of the male connector. The sizes of the contacts used for each signal may also be varied in order to allow for different signal timing or other desired characteristics (e.g., larger contacts closer to the contact end can be used for signals that should be connected prior to other signals, which may be carried by smaller contacts that are located closer to the terminal end).

FIGS. 2A and 2B illustrate a female connector 160 that is configured to be coupled to the male connector 120 of FIGS. 1A-1C. FIG. 2A shows a side cut-through view of the female connector 160. FIG. 2B shows a cross-sectional view of the female connector 160 at location B-B.

As shown in FIG. 2A, in this embodiment, the female connector 160 is implemented as a peek contact assembly. The female connector 160 includes an outer, immovable sleeve 165 surrounding a cavity 175. When the female connector 160 is not attached to the male connector 120, a peek plug 180 blocks the contact-end of the cavity 175, thus preventing fluids from entering the cavity 175 (or at least reducing the amount of fluids entering the cavity 175). The peek plug 180 can include one or more gaskets (e.g., in the form of O-rings surrounding the circumference of the peek plug) that reduce the likelihood of fluids reaching the electrical contacts 185 on the female connector 160 when the female connector 160 is not mated to the male connector 120.

Terminals 190(1)-190(6) (collectively, terminals 190), only two of which can be seen in this view, that are to be connected to an electrical device are located at the terminal end of the female connector 160. These terminals are electrically connected, via connections running through the sleeve, to corresponding electrical contacts 185. In this example, the electrical contacts 185 are implemented as contact blocks that are recessed into the inner surface of the sleeve 165. The contact blocks 185 can be implemented, in one embodiment, as slightly curved metal contact plates. As shown in FIG. 2B, the contact plates 185 in the female connector 160 are aligned in the same radial positions as the ball plunger contacts 125 in the corresponding male connector 120 of FIG. 1B. The ball plunger contacts 125 and contact blocks 185 are designed to provide a low-resistance electrical connection with each other when the male 120 and female 160 connectors are fully mated.

As with the male connector's ball plunger contacts 125, the female connector's contact blocks 185 can be electrically isolated from each other using insulating material (e.g., such as one or more appropriate gaskets). Such insulating material can be placed on and/or recessed at least partially into the inner surface of the female connector's sleeve 165.

A wave spring 195 located inside of the cavity 175 forces the peek plug 180 outwards towards the contact end of the female connector 160. The peek plug 180 is designed to be displaced as the male connector 120 is brought into contact with the female connector 160, compressing the wave spring 195. Any fluids that have entered the cavity will be forced out of the cavity 175 via a bleeder port 197 as the wave spring 195 is compressed.

Figure 3:
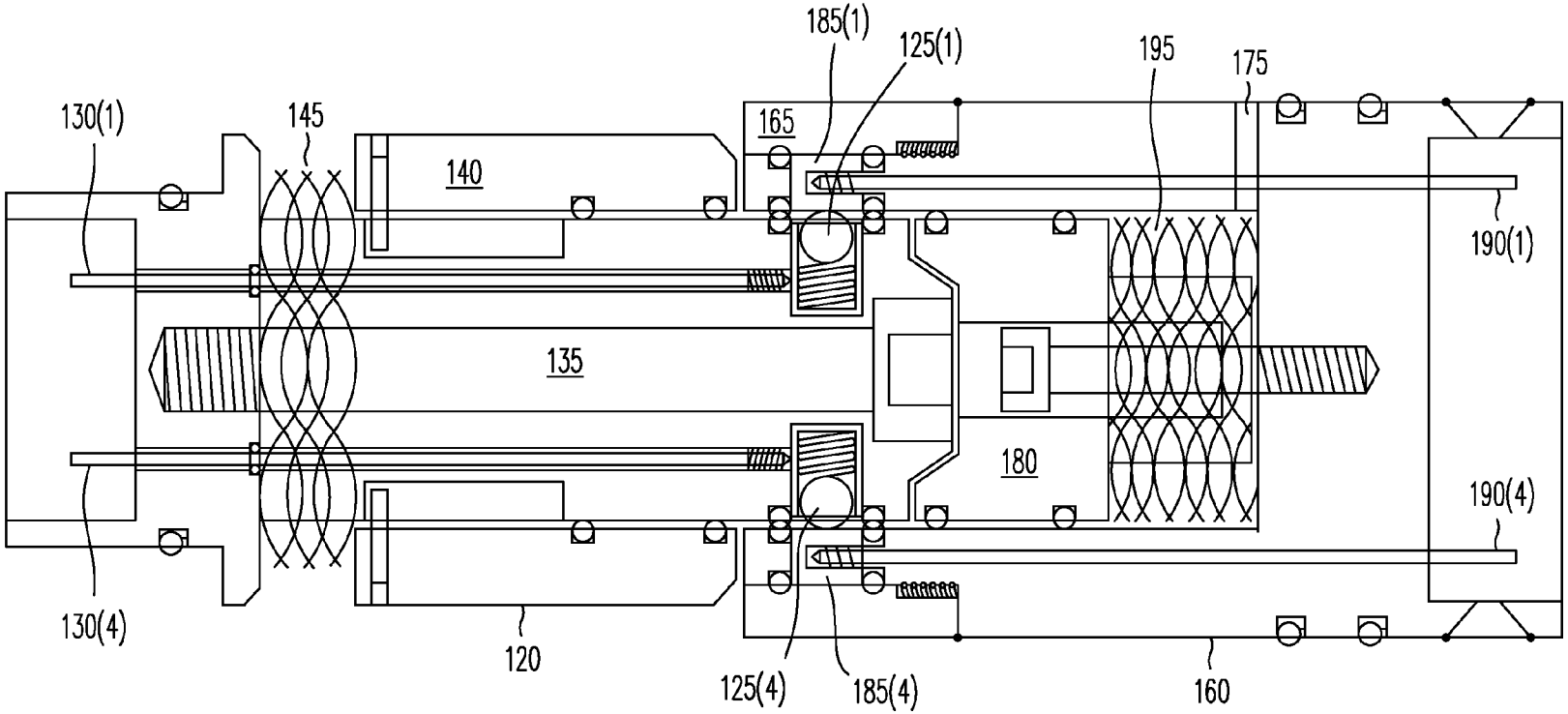
FIG. 3 shows a side view of a wet-connect that includes the male connector of FIGS. 1A and 1B coupled to the female connector of FIGS. 2A and 2B.

FIG. 3 illustrates how the male connector 120 of FIGS. 1A-1C and the female connector 160 of FIGS. 2A-2B are arranged with respect to each other when the two connectors are mated to each other. As shown, when the connectors are brought into engagement with each other, the outer sleeve 165 of the female connector 160 displaces the peek sleeve 140 of the male connector 120 towards the terminal end of the male connector 120. The inner bolt 135 of the male connector 120 extends into the cavity 175 within the female connector 160, displacing the peek plug 180 towards the terminal end of the female connector 160. As these displacements occur, the wave springs 145 and 195 in both the male and female connectors are compressed. Additionally, the ball plunger contacts 125 on the outer surface of the bolt 135 on the male connector 120 are brought into electrical contact with the corresponding contact blocks 185 on the inner surface of the sleeve 165 of the female connector 160. Furthermore, the peek sleeve 140 on the male connector 120 is pushed up against the outer sleeve 165 of the female connector 165 by the force of the male connector's wave spring 145, reducing the likelihood of fluids entering the mated wet-connect.

Thus, when force is applied to the male and female connectors, the electrical contacts on each are connected. The engagement force also causes the peek sleeve 140 and peek plug 180 to slide into a new position that exposes respective contacts.

In some embodiments, the components of the wet-connect can be made of materials that are designed to be resistant to damage resulting from exposure to a fluid-filled environment. For example, the contacts can be made of a material that has a noble-metal surface or is otherwise designed to be corrosion resistant, in case the wet-connect is exposed to corrosive fluids. In some embodiments, such a material can be selected so that the material will not develop a significant oxide or sulfide layer due to chemical reactions caused by exposure to certain fluids. Materials that may be considered can include stainless-steel (such as Alloy 316), high-nickel alloys (such as Inconel™), and the like.

Similarly, the material used to implement the peek sleeve 140 and/or peek plug 180 can be selected to provide electrical insulation while being capable of being shaped or molded into the necessary shape. Such materials can include Teflon™, PEEK™, ceramic, or the like.

The insulating material used to electrically isolate the contacts on a given connector from each other can be selected so that the material will be compressed by a corresponding sleeve and/or piston when the connector is engaged and/or disengaged from the other connector.

In some embodiments, the male and female connectors can include pressure-sealed feed-through sections on each of the connecting wires leading to the terminals that are designed to prevent the ingress of fluids into the corresponding electrical circuits in high-pressure fluid-filled environments.

As shown in the above figures, especially 1B and 2B, the male 120 and female 160 connectors both need to be rotationally aligned in order for the proper signal connections to be made when the male and female connectors are mated. Otherwise, signal cross-connect might result (e.g., if the power contact on the male connector was accidentally aligned with a signal contact on the female connector).

For purposes of this example, assume that contacts 125(1) (on male connector 120) and 185(1) (on female connector 160) have been assigned to carry a power signal. In order to avoid undesired cross-connect, the wet-connect should only allow the male and female connectors to be fully mated when contact 125(1) is in the same relative radial position as contact 185(1). Thus, when properly aligned, as shown in FIG. 3, contact 125(1) will be electrically coupled to contact 185(1). One or both of the two connectors can be designed in a manner that prevents cross connection (e.g., so that the connectors cannot be fully mated if contact 125(1) is in a radial position that would allow it to accidentally connect with any of contacts 185 other than contact 185(1).

The surface of the male and/or female connector can include a mechanism that forces the connectors to be properly aligned with one another before the two connectors are allowed to be mated. For example, the outer sleeve of the female connector can include a recessed area (e.g., near the top of the female connector) on the inside surface. The outer surface of the bolt of the male connector can include a corresponding protrusion (e.g., near the top of the male connector), such that the bolt of the male connector will only be able to be inserted into the cavity of the female connector when the male connector's protrusion is aligned with the female connector's recess. A mechanism such as this may require that the connectors be properly aligned before being forced into engagement with each other, and will ideally prevent the contacts on the two connectors from coming into contact with each other until the two connectors have been rotationally aligned with each other enough to prevent accidental cross connections.

In other embodiments, the female connector's sleeve 165 can implement a spiral helix and the male connector can implement a corresponding key (e.g., on the bolt). Use of a spiral helix causes the two connectors to become properly rotationally aligned as the connectors are forced into engagement with each other, regardless of their relative alignment at the beginning of the mating process. Thus, the spiral helix translates at least some of the engagement force into rotational alignment force if rotational alignment is needed.

The above example describes a wet-connect that uses particular types of alignment mechanisms, connector types, and electrical contact types. Other embodiments may use different techniques to implement a wet-connect instead of and/or in addition to those described herein. For example, in one alternative embodiment, the male connector may include contact blocks while the female connector includes ball plunger electrical contacts. Another embodiment may use different types of contacts altogether. In another alternative embodiment, the wet-connect may not include the protective peek sleeve and/or peek plug shown in the above examples.

While the above description focuses on arrangements of contacts that are radially distributed in more or less the same cross-sectional plane of the connectors, other embodiments can include contacts that are distributed in several distinct cross-sectional planes of each connector. Regardless of which plane each contact is located in, the contacts can be distributed so that only one contact is located at each angular position (if it is desirable to ensure that no cross-connections are made during the mating process). For example, a first plane can include four contacts spaced 90 degrees apart, at 0, 90, 180, and 270 degrees. A second place can include four additional contacts, also spaced 90 degrees apart, at 45, 135, 225, and 315 degrees.

A wet-connect like that described above can be used, for example, in a BHA. Such a wet-connect could be used to connect electrical components within a drilling subassembly to a replaceable battery or other power supply. For example, either the male or female connector could be electrically coupled to an electrical component, such as a measurement-while-drilling (MWD) tool, that is part of a BHA. The other connector could be coupled to a removable power supply for the MWD tool. If the power supply failed, the wet connect could be decoupled by pulling the male and female connectors apart (e.g., by pulling the failed power supply towards the surface using a wireline retrieval). The power supply could be repaired or replaced, reattached to the appropriate portion of the wet connect, and lowered back down the wellbore. The force of gravity would then cause the male and female connectors to realign and reconnect to each other. This allows electrical components to be replaced without needing to pull the entire BHA back to the surface. Since the wellbore may contain various fluids and other contaminants, the ability of a wet-connect like that shown above to keep fluids from coming into contact with the electrical contacts is desirable.

Figure 4:
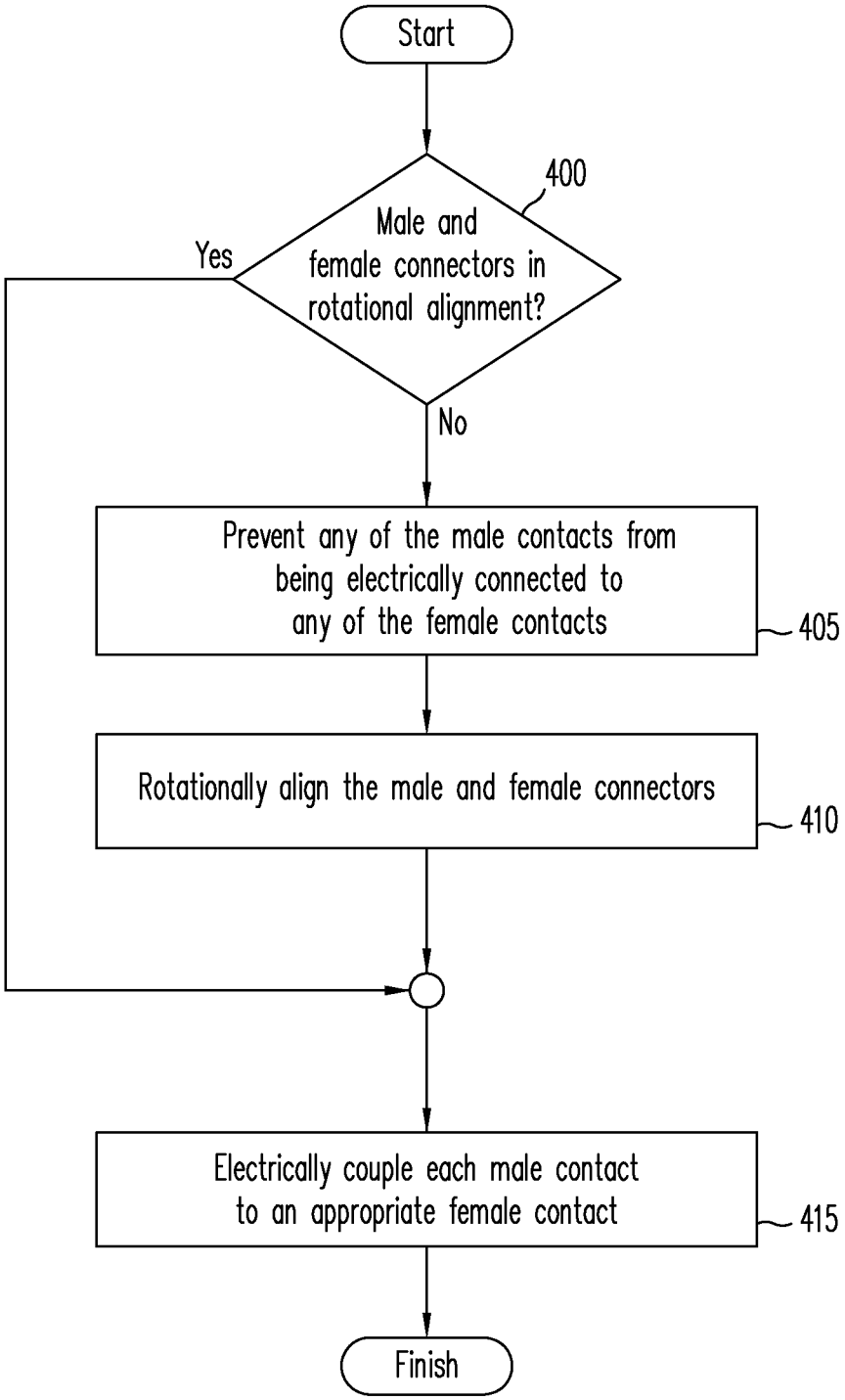
FIG. 4 is a flowchart illustrating a method of connecting a radial wet-connect, according to one embodiment of the present invention.

FIG. 4 illustrates a method of using a wet-connect like that described above. This method connects a male connector (e.g., like male connector 120 above) to a female connector (e.g., like female connector 160 above) in order to allow the electrical contacts on the male connector (referred to below as "male contacts" for brevity) to be electrically connected to the appropriate electrical contacts on the female connector (referred to below as "female contacts"). This method is initiated when the two halves (i.e., the two connectors) of the wet-connect are brought into proximity with each other and force is applied in order to being the process of mating the two connectors to each other.

As shown, the method begins at 400. If the two connectors are in proper rotational alignment (e.g., so that a contact carrying to one signal is not at risk of accidentally connecting to any contact carrying to a different signal), as determined at 400, the two connectors are mated so that the male contacts are electrically coupled to the appropriate female contacts, as shown at 415. The appropriate contacts to electrically connect at 415 are those that have been assigned to carry the same signal. For example, when properly rotationally aligned, mating the male and female connectors will cause a male contact assigned to carry a power signal to a corresponding female connector that has also been assigned to carry that same power signal. Likewise a male contact assigned to carry a ground signal will be electrically connected to a female contact assigned to carry the ground signal.

If the two connectors are not in the proper rotational alignment, male contacts on the male connector are prevented from coming into contact with any of the female contacts on the female connector in order to prevent any accidental signal cross-connections, as shown at 405.

The two connectors are then rotationally aligned, as indicated at 410. Rotationally aligning the two connectors involves rotating one or both of the connectors until contacts assigned to the same electrical signal are in the same relative radial position on each of the contacts. This can be performed by aligning a protrusion on the surface of one connector (e.g., a key) with a slot or other feature (e.g., a notch or spiral helix) on the surface of the other connector). These physical features both mark the proper alignment and prevent the connectors from being mated until they are properly aligned. Once the connectors are in proper rotational alignment, the two connectors are mated at 415.

Although the present invention has been described in connection with several embodiments, the invention is not intended to be limited to the specific forms set forth herein. On the contrary, the present invention is intended to cover such alternatives, modifications, and equivalents as can be reasonably included within the scope of the invention as defined by the appended claims.

What is claimed is:

1. A system, comprising:

a first connector, wherein the first connector comprises a first plurality of electrical contacts, wherein the first plurality of radial contacts are radially distributed around a portion of the first connector; and a second connector, wherein the second connector comprises a second plurality of electrical contacts, wherein the second plurality of electrical contacts are radially distributed around a portion of the second connector; wherein the first connector comprises a plurality of O-ring gaskets, wherein each of the O-ring gaskets surrounds a respective one of the first plurality of electrical contacts.

2. The system of claim 1, wherein the first connector comprises a bolt, wherein the first plurality of electrical contacts are distributed around a radius of the bolt, wherein the second connector comprises an immovable sleeve, and wherein the second plurality of electrical contacts are radially distributed around an inner surface of the immovable sleeve.

3. The system of claim 2, wherein the first connector comprises a movable peek sleeve over the bolt, wherein the second connector comprises a movable peek plug inside the immovable sleeve, wherein the movable peek sleeve is configured to retract to expose the first plurality of electrical contacts on the bolt in response to the immovable sleeve being pushed onto the bolt, and wherein the movable peek plug is configured to recede until the second plurality of electrical contacts on the inner surface of the immovable sleeve are exposed in response to the bolt being pushed into the immovable sleeve.

4. The system of claim 1, wherein the first connector comprises first insulating material configured to electrically isolate each of the first plurality of electrical contacts from each other.

5. The system of claim 4, wherein one of the first plurality of electrical contacts comprises an electrically conductive ball.

6. The system of claim 1, wherein the first connector is attached to a power supply for use within a wellbore, and wherein the second connector is attached to an electrical device within a bottom-hole assembly within the wellbore.

7. The system of claim 1, wherein the first connector is configured to inhibit exposure of the first plurality of electrical contacts to fluids, while the first connector is not mated with the second connector.

8. The system of claim 1, wherein the first connector comprises a gasket surrounding the portion of the first connector, and wherein the gasket is configured to be displaced by the second connector when the first and second connectors are mated.

* * * * *